US005485829A

United States Patent [19]

Santhouse et al.

[11] Patent Number: 5,485,829

[45] Date of Patent: Jan. 23, 1996

[54] CENTRAL BODY FOR USE IN REGULATION SYSTEMS OF CATALYTIC BURNERS

[75] Inventors: Daniel Santhouse, Wilton; H. Roy Taylor, Stratford, both of Conn.

[73] Assignee: Conair Corporation, Stamford, Conn.

[21] Appl. No.: 251,755

[22] Filed: May 31, 1994

[51] Int. Cl.[6] ..... F23Q 2/00; F23Q 2/42

[52] U.S. Cl. ..... 126/409; 431/344; 431/255; 431/328; 431/345

[58] Field of Search ..... 431/344, 255, 431/345, 354, 328; 126/408, 409, 406

[56] References Cited

U.S. PATENT DOCUMENTS

| | | | |
|---|---|---|---|
| 3,620,660 | 11/1971 | Laurent | 431/344 X |
| 3,907,490 | 9/1975 | Schaller | 431/344 X |
| 4,932,393 | 6/1990 | Sim | 431/344 X |

FOREIGN PATENT DOCUMENTS

| | | | |
|---|---|---|---|
| 2398965 | 3/1979 | France | 431/344 |

*Primary Examiner*—Carl D. Price
*Attorney, Agent, or Firm*—Haynes N. Johnson

[57] ABSTRACT

A moldable central body for use in a catalytic burner has a generally rotational symmetry about a longitudinal axis. It provides a cover retaining surface for the cover of the unit; furnishes the bayonet pin for receiving the cover; carries spacers positioning itself within the outer casing; holds the wave member in position; holds the stem support in position, which, in turn, holds the valve seat; provides a pivot hole for the spoon pivot for a curling iron; is a seat and shoulder for the diaphragm; provides an inner surface to hold alignment members for the control stem; holds the seat for the spring for the control stem; and provides a barrel retaining surface for a curling iron barrel. The control stem of a regulation element moves axially within the central body.

The central body can be molded of plastic as a single integral piece. Since this central body serves so many functions and, yet, can be molded as a single integral piece, it reduces the cost of manufacture of the burner of this invention.

8 Claims, 4 Drawing Sheets

CENTRAL BODY FOR USE IN REGULATION SYSTEMS OF CATALYTIC BURNERS

FIELD OF THE INVENTION

This invention relates to the field of catalytic burners of a type which can be used for heating personal care appliances, such as curling irons. The catalytic burner uses a gas, such as butane, and combusts it catalytically. In particular, this invention relates to a moldable central body which is associated with regulation of the gas pressure and which serves multiple functions in operation of the burner.

BACKGROUND OF THE INVENTION

Most systems for regulating gas pressure in catalytic burners involve the seating and unseating of a valve seat located at the mouth of a canister containing the gas. When the valve seat is moved from the opening, gas flows around it and into the system. This is often difficult to regulate precisely and can involve the use of many parts.

The present system, by contrast, has no controlling valve as such at the canister, but has a valve stem through which the gas flows, and flow through the valve stem is controlled.

Preparation and positioning of the numerous parts required for such a system involves many steps and can add to the manufacturing cost. Our invention serves to reduce these costs by using a central body which is moldable and which serves to accomplish many of the functions which would normally require numerous separate pieces.

BRIEF SUMMARY OF THE INVENTION

The burner of this invention will be described with reference to its use in a curling iron.

The burner includes a receptacle at one end of the curling iron for a gas canister. Upon insertion of the canister, a seat or probe presses against the canister valve, opening it; and it thereafter remains open. Gas then flows to the input end of a control stem and, depending upon the longitudinal positioning of the control stem, flows into the stem through a gas inlet orifice in one side of the stem and travels in a channel within the stem to an outlet orifice at the other end. There it enters a Venturi, is mixed with air, passes from there through a mixing chamber and to a burning chamber within the barrel of the curling iron. The catalytic burner is located in the burning chamber. The control stem is spring-pressed in a direction to keep the gas inlet orifice normally in the open position.

Movement of the control stem a slight distance in a direction away from the canister and toward the Venturi blocks the gas inlet orifice and stops gas flow. This movement can be caused by use of a shut-off cam, or by the action of a pressure regulator.

The pressure regulator has a flexible pressure-regulating diaphragm surrounding, and sealed to, the stem and extending to a sealed contact with the walls of a regulator body (central body). Gas from within the stem channel passes from the channel through a pressure-regulating orifice to the canister side of the diaphragm, pressing against it, and, so, opposing the stem spring. If the pressure becomes sufficiently great, the stem will be moved against the spring, serving to close the gas inlet orifice, thus shutting off gas flow. This reverses itself, opening the orifice again, once the pressure has dropped as a result of burning of gas.

A central body is used to provide a number of functions. It provides a cover retaining surface for the cover of the unit; it furnishes the snap seat for receiving the cover; it carries spacers positioning itself within the outer casing; it holds the valve member in position; it holds the stem support in position, which, in turn, holds the valve seat; it provides a pivot hole for the spoon pivot for a curling iron; it is a seat and shoulder for the diaphragm; it provides an inner surface to hold alignment members for the control stem; it holds the seat for the spring for the control stem; and it provides a barrel retaining surface for a curling iron barrel. The control stem moves axially within the central body.

The central body can be molded of plastic as a single integral piece. Since this central body serves so many functions and, yet, can be molded as a single integral piece, it reduces the cost of manufacture of the burner of this invention.

DETAILED DESCRIPTION OF THE INVENTION

Introduction

Figure 1:
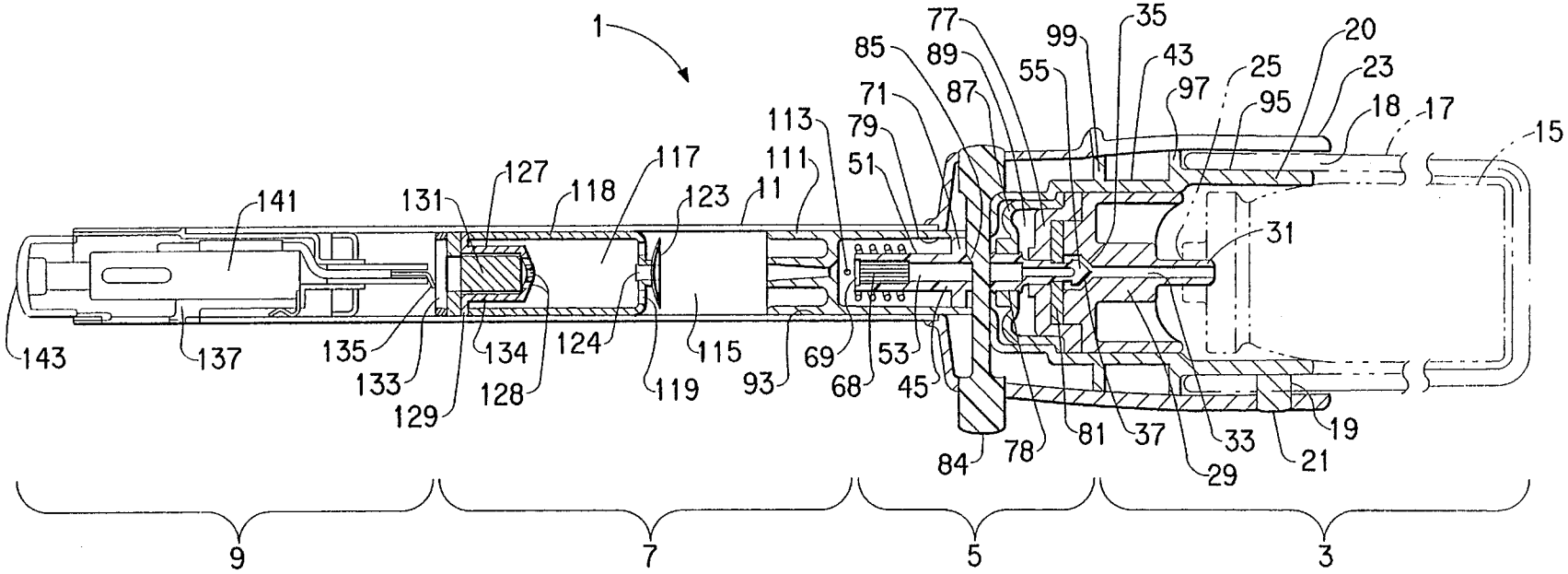
FIG. 1 is a longitudinal transverse section through the entire burner of this invention.

Catalytic burner 1 is made up of several interrelated sections (FIG. 1): a fuel supply section 3, a control section 5, a mixing and burning section 7, and an ignition section 9. Though it can be used for many purposes, it will be described in connection with one use, heating a curling iron. Thus, it includes a metal curling iron barrel 11, a casing or handle 13, and a cover 17 for a gas canister 15. The cover forms an extension of the casing.

When a canister of gas is installed in the burner, the valve on the canister is opened by a probe 31 and remains open until the canister is removed. Fuel flow is from the canister through gas channel 37 into a central longitudinal channel 53 in a control stem 45, out an outlet orifice 69 at the other end of the control stem 45, through a Venturi 111 for mixture with air, and then into the catalytic burner 127. Control mechanisms serve to control pressure and temperature.

Pressure is controlled by the position of control stem 45 which moves longitudinally in the direction of the longitudinal axis of handle 13. The extent of its motion is limited by seats 57 and 65 on it which engage with rubber valve seat 81. The stem is spring pressed toward the canister, which is the open position.

The Fuel Supply Section

The fuel supply section serves to supply the gas to be burned, normally butane. The gas is contained, under pressure, in canister 15 which is held in place by cover 17. Cover 17 fits within slot 18 formed by the rear edge 23 (of the outer casing 13) and a rearwardly extending flange 20, just inside the rear edge of the outer casing 13. Flange 20 is part of central body 43, described below. The cover 17 is held in place by snap seat 19 (on the cover) which fits about outwardly-extending bayonet pin 21 on the central body 43.

Canister 15 has a spring-pressed valve 25 of the usual type. The central body 43 carries valve member 29, which includes a probe 31 with an internal channel 33. When the canister 15 is in position within cover 17, probe 31 presses against valve 25, opening it so that gas flows through channel 33. Valve 25 is held in the open position by probe or seat 31 for the entire time that the. canister is in place, permitting gas to flow through channel 33.

Gas flow thereafter is controlled by slight longitudinal motion of control stem 45. It is "on" when stem 45 is in its position closest to the canister (FIG. 2); it is "off" when stem 45 is in its position farthest removed from the canister (FIG. 3). The motion of the control stem 45 is limited by fluted seat 57 contacting rubber valve seat 81. Control stem 45 is spring-pressed by spring 70 to the "on" position. Thus, a force must be exerted on stem 45 to turn the burner off.

The outlet end of channel 33 is formed as a recess 35. The end of the longitudinally movable control stem 45 closest to the canister, that is, end socket 55, fits within recess 35, forming gas channel 37 between end socket 35 and the walls of recess 35. The stem and its end socket 55, however, are constrained from moving in the direction of channel 33 far enough to actually close the channel. Thus, gas channel 37 is always open, permitting the flow of gas from the canister to the channel.

Figure 2:
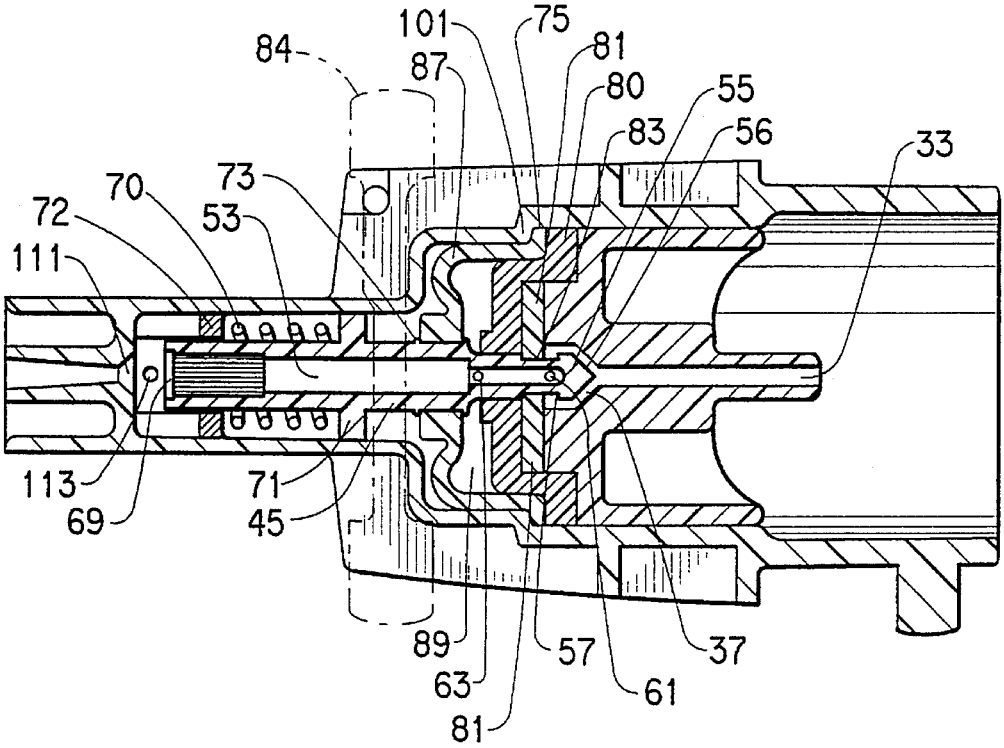
FIG. 2 is an enlarged portion of the section of FIG. 1, showing the control stem in the position which results in gas flowing through the unit.
Figure 3:
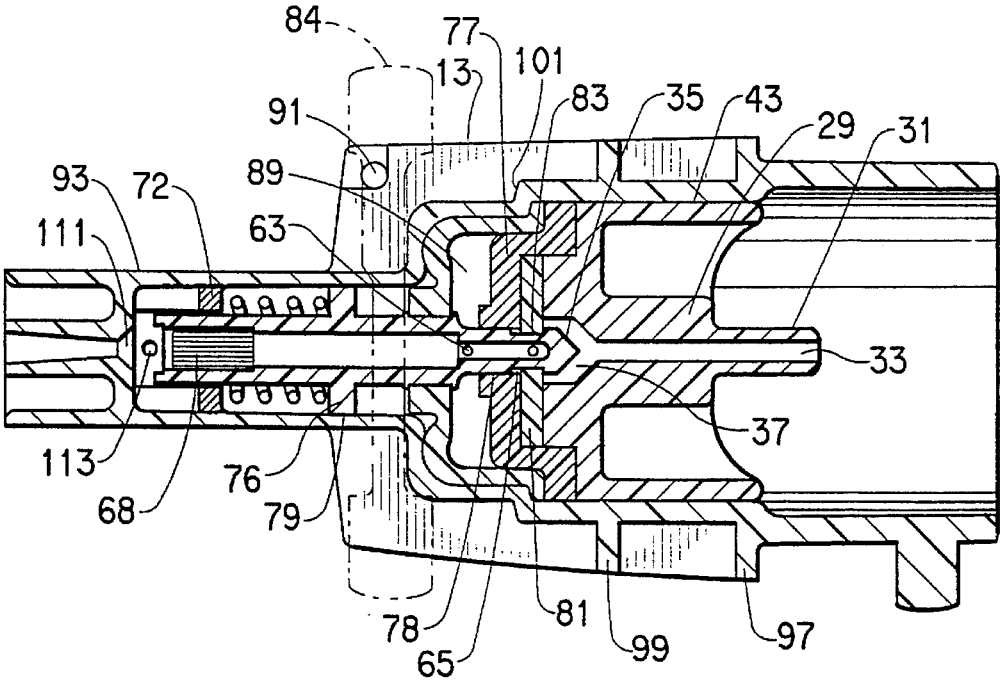
FIG. 3 is similar to FIG. 2, but with the control stem in the position which results in gas not flowing through the unit. It will be in this position either when the unit is turned off or when the pressure regulator has caused a temporary disruption of gas flow.

It can be seen, however, by comparing FIGS. 2 and 3, that gas can enter inlet orifice 61 only when control stem 45 is in its position closest to the canister. If it is in its position removed from the canister (FIG. 3), inlet orifice 61 is within hole 83 in valve seat 81, and the valve seat 81 seals inlet orifice 61 closed. This prevents flow to gas inlet orifice 61.

The Control Section

Figure 4:
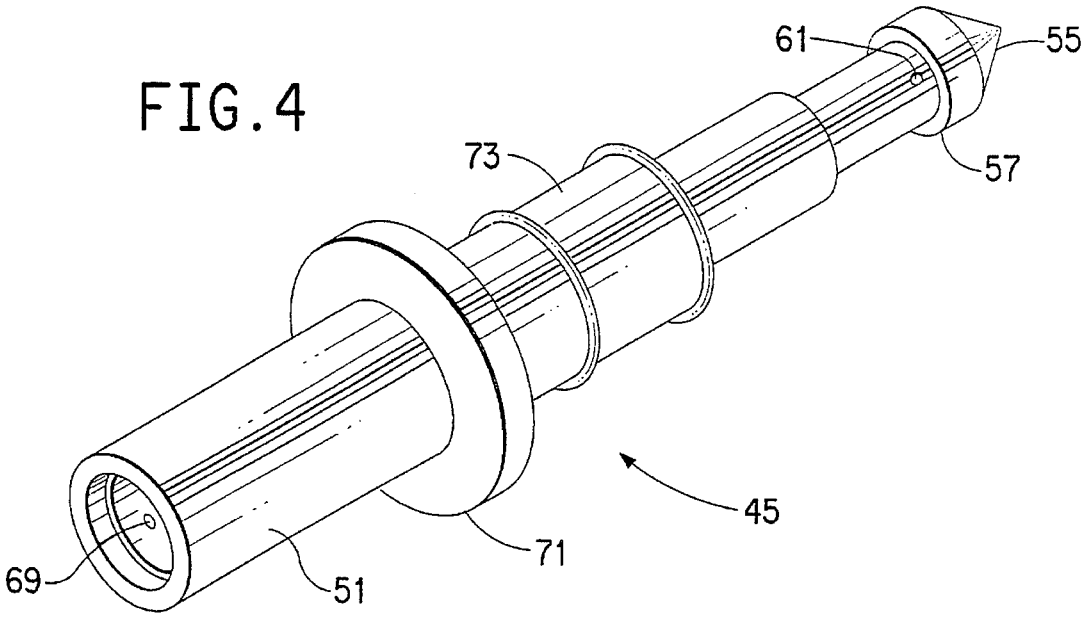
FIG. 4 is a perspective view of the control stem itself.

Control stem 45 (FIG. 4) has a generally tubular body 51 with an internal longitudinal channel 53 which runs from its gas inlet orifice 61 (near the canister end) to gas outlet orifice 69 at the other end. Inlet orifice 61 runs transversely into control stem 45, beginning behind end socket 55, proximate to seat 57. Gas flows from the canister to gas channel 37 which carries it around end socket 55 and into gas inlet orifice 61. A filter 68 is positioned within channel 53 proximate to outlet orifice 69.

Control stem 45 is mounted within central body 43 for axial movement. This movement is along the longitudinal axis of the control body and the longitudinal axis of handle 13 and barrel 11. It is held by alignment members 76 on the stem which slidingly contact the inner surface 79 of central body 43, and by the bearing opening 78 in stem support 77. The extent of its axial movement is limited, as stated above, by seats 57 and 65 pressing against valve seat 81.

The control stem 45 is spring-pressed toward the canister by spring 70 which fits against seat 71 on the stem and seat 72 on the central body.

This latter feature results from the use of a differential pressure valve. This valve is formed by flexible diaphragm 87 which is sealed to diaphragm seat 73 on the control stem and diaphragm seat 75 on the inner surface 79 of the central body 43. The tightness of the latter seal is assured by fitting the outer rim 88 of the diaphragm between a shoulder 101 on the central body and the outer rim 80 of stem support 77.

The diaphragm 87 and the stem support 77 form a pressure control plenum 89, through which control stem 45 passes. Longitudinal channel 53 of the control stem is connected to the plenum by pressure control orifice 63. Thus, the gas pressure in channel 53 enters the plenum and presses against the diaphragm, tending to push the control stem in a direction away from the canister. This pressure is opposed by the force of spring 70, so that, under normal conditions, the control stem does not move. In the event, however, that the gas pressure becomes too great, i.e., greater that the opposing force, the control stem will move in a direction away from the canister. This will cause inlet orifice 61 to move within valve seat 81 and so prevent any further gas from being delivered to gas inlet orifice 61. The pressure in plenum 89 then drops as gas flows from the plenum through control orifice 63 and out the outlet orifice 69, allowing the control stem to move toward the canister, and starting gas flow again.

This same movement of the control stem 45 is used to turn the unit off and on. A cam 84 forces the stem in a direction away from the canister when one wishes to shut off the unit; and releases it to return to its original position when it is to be turned on. Thus, sliding cam 84 is mounted in handle 13 for sliding transverse movement. It has an angled cam shoulder 85 which can press against seat 71. When cam 84 is in the "off" position, seat 71 is pressed cam shoulder 85 in a direction which slides control stem 45 to its "off" position. When cam 84 is in the "ion" position, cam shoulder 85 does not press against seat 71, allowing gas to flow.

Thus, as can be seen, control stem 45 serves a variety of functions. Except for the diaphragm 87 and spring 70, it is essentially the only moving part, reducing the cost of manufacture.

The Central Body

Figure 5:
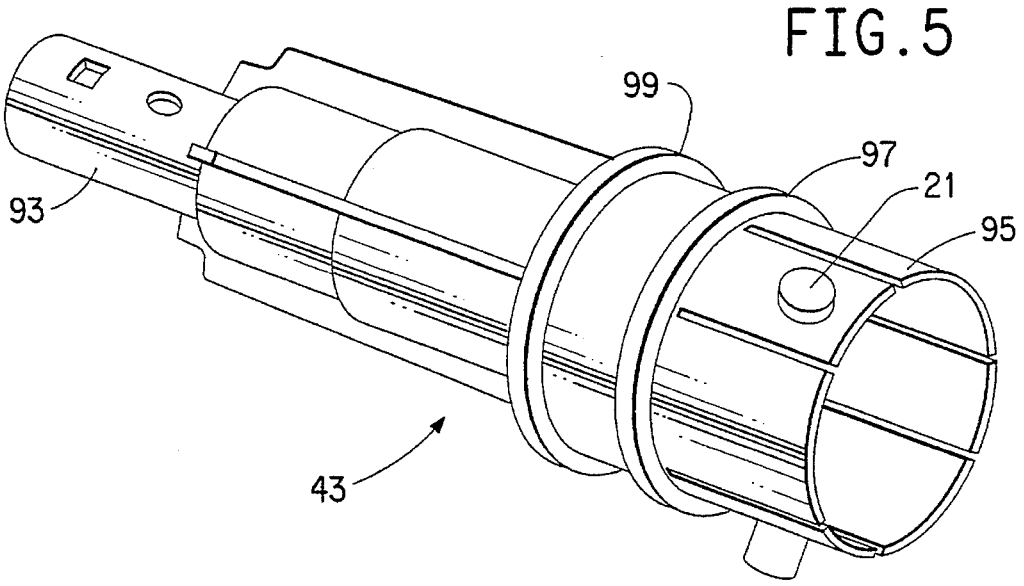
FIG. 5 is a perspective view of a central body. The control stem is mounted within, and slides longitudinally in, the central body.
Figure 6:
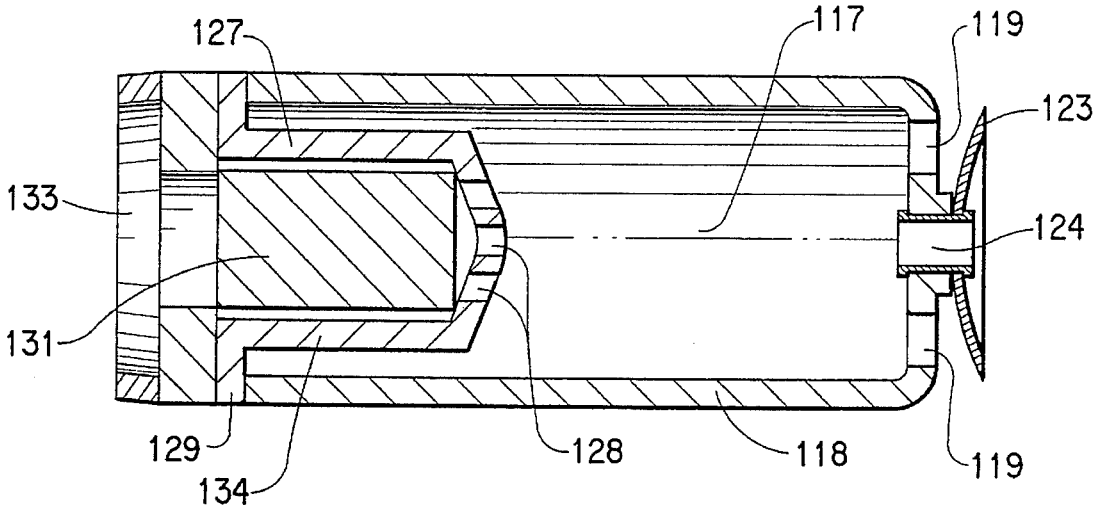
FIG. 6 is a transverse section through the bimetallic temperature control. It shows the normally-open position, when the burner is operating at the desired temperature.
Figure 7:
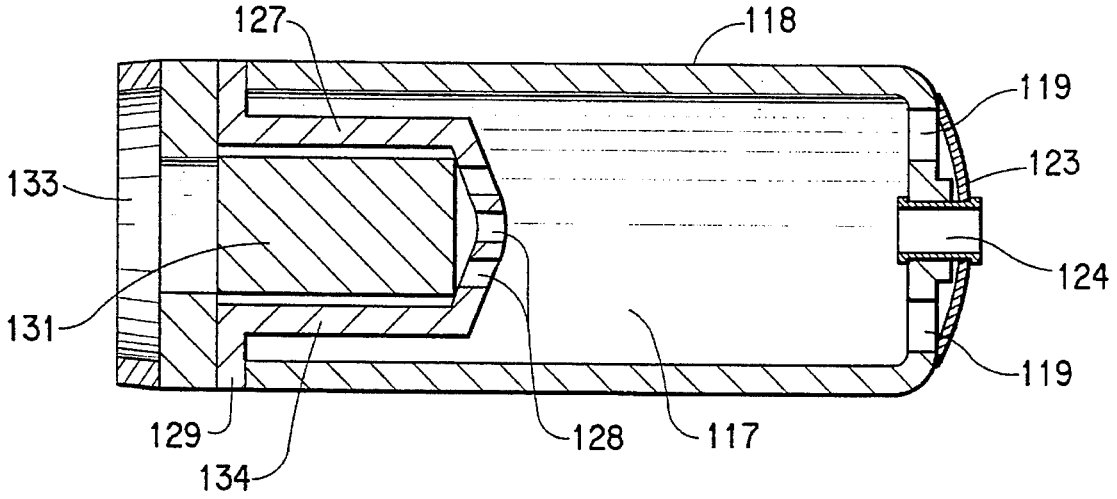
FIG. 7 is a section similar to FIG. 6. It shows the cut-off position, when the temperature is too hot and the flow of gas-air mix is reduced.

Central body 43 (FIG. 5) is a single integral piece which serves a number of functions. Body 43 provides a cover retaining surface 95 to receive and hold the canister cover 17 between the central body and the rear edge of casing 13. It furnishes the pin 21 for receiving and holding the cover. It carries spacers 97 and 99 for positioning and holding itself within outer casing 13. It positions and holds valve member 29 in position. It holds stem support 77, for control stem 45, in position, which, in turn, holds valve seat 81. It provides a pivot hole 91 (FIG. 3) for the pivotted spoon for a curling iron. It provides a seat 75 and shoulder 101 for the diaphragm 87 (FIG. 2). It provides an inner sliding surface 79 to hold alignment members 76 for control stem 45. It holds seat 72 for spring 70 (which spring-presses control stem 45 to its open valve position). It provides barrel retaining surface 93 for curdling iron barrel 11. It provides the venturi 111 for air mixing.

Central body 43 has generally rotational symmetry about a longitudinal axis which is common with the longitudinal axis of control stem 45. (It lacks such symmetry only where it has individually functioning parts, such as the bayonet pin or snap detail 21). The radius of the outer surface of the central body varies along its longitudinal axis, being smaller where it is to receive the curling iron barrel 11, and wider where it receives the diaphragm 87, forming the pressure control plenum 89 and surface 95 where it receives the cover 17 for the canister. Control stem 45 moves within the central body along the common longitudinal axis of the central body and the control stem.

Central body 43 is shaped to be molded of plastic as a single integral piece, and easily removable from the mold. Since this central body 45 serves so many functions and, yet, can be molded as a single integral piece, it reduces the cost of manufacture.

In using the central body to assemble a burner control unit, the parts inside the central body are first assembled and secured in place within it. That is, spring 70, diaphragm 87, stem support 77, valve seat 81, and valve member 29 are mounted on control stem 45; and the stem is inserted within central body 43. These members, fitted on control stem 45, have outer diameters such that they fit against, and can be secured to, the inner surface of central body 43. Central body 43 is then fitted within and secured to barrel 11 and casing 13.

The Mixing and Burning Section

Gas leaving outlet orifice 69 at the end of control stem 45 enters Venturi 111. The Venturi action draws air in through bleed hole 113, which mixes with the gas; and the air-gas mixture enters mixing chamber 115 for further mixing. It then enters cylinder 118, which forms a combustion chamber 117, through holes 119.

Catalytic burner 127 is mounted within cylinder 118, has entrance openings 128 to receive the air-gas mix, and contains a catalyst 131. The burner 127 may be of the type described in Roldan et al. U.S. Pat. No. 5,178,530. The gas is combusted in the catalyst, and the products of combustion leave through opening 133 and then through openings in the barrel.

Temperature Control

To control temperature, a round bimetallic disk 123 is mounted in central hole 124. Control hole 124 is positioned between holes 119 which connect the two chambers 115 and 117. The disk is dimensioned such that it can fit holes 119 and cover them.

When the temperature of the unit is in the desired range, or less, the disk does not cover the holes. However, when the temperature is hotter than desired, the disk flexes and covers holes 119, preventing flow of the air-gas mixture through them. It does not cut all flow, and some of the mixture will still. flow through the central hole 124; this remaining flow will be enough to keep the burner operating, but not so much as to keep it at the undesirably hot temperature.

Since most of the air-gas mix cannot now reach the catalytic burner 127, it backs up and leaves the unit through bleed hole 113, entering the atmosphere, as in Roldan et al. U.S. Pat. No. 5,178,530. Once the unit cools sufficiently, the disk flexes back, and holes 119 are reopened, returning the unit to normal operation.

In the event of excessive, unsafe overheating, spring seat 72 on the central body fuses, as discussed above, and releases the spring 70. This results in the control stem 45 moving in a direction away from the canister, permanently cutting off gas flow.

Ignition

A piezoelectric ignition system is used for the catalytic burner. It is, however, less expensive than some since it requires only one electrode.

A piezoelectric crystal 141 of the usual type is positioned within barrel 11 at its outer end. It has one electrode 135 facing inwardly and going to the burned gas outlet 133 of the catalytic burner. Its other electrode is formed by the crystal being in electrical contact, at point 137, with metal barrel 11. The metal frame 124 of burner 127 also makes electrical contact with the barrel 11, at point 129, completing the circuit.

An ignition button 143, spring-pressed outwardly, is positioned at the outer end of the barrel and is used to actuate the crystal 141. When the unit is first turned on, gas will flow and an air-gas mixture will enter the catalytic burner 127, and will leave unburned through outlet 133, since the burner is not at operating temperature initially. Button 143 is pressed, causing a spark between electrode 135 and metal frame 134, igniting the mixture. Once the burner reaches operating temperature, catalytic combustion commences, and the flame goes out.

We claim:

1. In combination a central body and a gas burner unit, said gas burner unit having a casing, a curling iron barrel, and a control stem with a control stem longitudinal axis, said central body being moldable as an integral piece, said central body having an outer surface, an inner surface, and a central body longitudinal axis, said central body having a generally rotational symmetry about said central body longitudinal axis, said outer surface of said central body having spacers thereon dimensioned to position said central body within said casing, said outer surface including an outer surface portion for holding said curling iron barrel, and said inner surface having an inner surface portion for holding said control stem within said body unit with said control stem longitudinal axis and said central body longitudinal axis being a common axis.

2. A combination as set forth in claim 1 in which said outer surface includes a second outer surface portion for holding a cover for a gas canister.

3. A combination as set forth in claim 1 including a stem support transverse to said central body longitudinal axis, said stem support being dimensioned to fit against said inner surface for holding said control stem within said body unit.

4. A combination as set forth in claim 1 including a shoulder on said inner surface to receive a pressure regulating diaphragm.

5. A combination as set forth in claim 1 in which said outer surface has at least two different radii, one said radius to receive said curling iron barrel and another said radius, removed from said curling iron barrel radius, to receive and hold a cover for a gas canister.

6. A combination as set forth in claim 5 in which said outer surface to receive said cover includes a pin for holding said cover in place.

7. A combination as set forth in claim 1 in which said outer surface includes a venturi area.

8. In combination, a central body and a catalytic burner, said catalytic burner including control stem alignment members, a diaphragm, a cover for a gas canister, an outer casing and a canister valve member, said central body having generally rotational symmetry about a longitudinal axis, said central body having an inner surface and an outer surface, said inner surface including a sliding surface to receive said control stem alignment members in longitudinally sliding relationship along said longitudinal axis, a seat to receive said diaphragm, a position to receive said control stem support, and a second position to receive said canister valve member, and said outer surface including a position for receiving said cover for a gas canister and spacers to fit said central body within said casing.

* * * * *